United States Patent [19]

Kikuchi et al.

[11] Patent Number: 4,526,486

[45] Date of Patent: Jul. 2, 1985

[54] SERIAL PRINTER

[75] Inventors: Hiroshi Kikuchi; Jiro Tanuma; Yoshinori Koshida; Takashi Itaya, all of Tokyo, Japan

[73] Assignee: Oki Electric Industry Co., Ltd., Tokyo, Japan

[21] Appl. No.: 576,863

[22] Filed: Feb. 3, 1984

[30] Foreign Application Priority Data

Feb. 7, 1983 [JP] Japan ..... 58-17472

[51] Int. Cl.[3] ..... B41J 33/22; B41J 19/20

[52] U.S. Cl. ..... 400/185; 400/225; 400/229; 400/320; 400/322; 400/323

[58] Field of Search ..... 400/320, 322, 323, 328, 400/229, 233, 225, 236.2, 221, 221.2, 223, 185

[56] References Cited

U.S. PATENT DOCUMENTS

| | | | |
|---|---|---|---|
| 3,776,340 | 12/1973 | Moser . | |
| 3,882,988 | 5/1975 | Sloan et al. | 400/320 X |
| 4,011,932 | 3/1977 | Wurscher et al. . | |
| 4,332,492 | 6/1982 | Thern et al. | 400/705.1 X |
| 4,461,588 | 7/1984 | Watanabe et al. | 400/320 X |

FOREIGN PATENT DOCUMENTS

| | | | |
|---|---|---|---|
| 3106434 | 1/1982 | Fed. Rep. of Germany | 400/322 |
| 161184 | 12/1981 | Japan | 400/322 |
| 110487 | 7/1982 | Japan | 400/233 |

*Primary Examiner*—Edgar S. Burr
*Assistant Examiner*—Charles A. Pearson
*Attorney, Agent, or Firm*—Peter L. Berger

[57] ABSTRACT

Disclosed is a serial printer comprising a carriage loaded with a printing head and moved in the horizontal direction, wherein a motor is contained in the carriage, a pinion is attached to a rotor shaft of the motor, a rack engaged with this pinion is attached onto a guide rail for movably supporting the carriage and the carriage loaded with the printing head is moved along the rack by rotating the pinion engaged with the rack by rotation of the motor.

In this serial printer, the power loss of the motor due to the presence of an intermediate power transmitting member indispensable for the conventional printer, such as a wire rope, a toothed belt or a screw shaft, can be eliminated, and occurrence of troubles due to stretching or deformation of this intermediate power transmitting member is prevented. Accordingly, the capacity of moving and positioning the printing head is increased. Furthermore, since the carriage is of the self-running type, it is possible to adopt an embodiment in which at least two carriages are mounted on one printer and they are independently moved to effect the delivery operation. Accordingly, the printing speed can be increased and multi-color printing can be performed.

9 Claims, 5 Drawing Figures

SERIAL PRINTER

BACKGROUND OF THE INVENTION

1. Field of the Invention

The present invention relates to a serial printer comprising a printing head loaded on a carriage, in which the carriage is moved in the horizontal direction to move the printing head loaded on the carriage in the horizontal direction for effecting the printing operation.

2. Description of the Prior Art

A conventional serial printer will now be described.

A carriage loaded with a printing head is connected to a part of a toothed belt or wire rope, and by moving this toothed belt or wire rope, the movement of the carriage is accomplished. According to another method, a screw shaft engaged with the carriage is pierced through the carriage and this screw shaft is rotated by a motor to move the carriage.

In the conventional apparatus, since a toothed belt or wire rope or a screw shaft is interposed between the carriage and the driving power source, that is, the motor as power transmitting means for effecting the movement of the carriage, the following disadvantages arise.

(1) Since the driving power of the motor does not act directly on the carriage, the power loss of the motor is inevitably caused.

(2) Because of stretching or deformation of the toothed belt or wire rope or the screw shaft as power transmitting means, the inertia of the carriage changes and a deviation is caused in the precision of the movement or positioning.

(3) Since the construction of parts is complicated, the assembling operation is very difficult and troublesome, and a large space is necessary for packaging the parts, with the result that it is very difficult to reduce the manufacturing cost and diminish the size of the apparatus.

SUMMARY OF THE INVENTION

According to the present invention, a recess is formed on the edge of a carriage which is loaded with a printing head and a ribbon cartridge and is moved in the horizontal direction, and a flat DC brushless motor is arranged in the bottom portion of the carriage and a pinion is attached to the lower portion of a rotor shaft of this motor. An output gear to be engaged with a ribbon feed power transmitting system is attached to the upper portion of the rotor shaft projecting in the upper portion of the carriage, and a rack to be engaged with the pinion is arranged in the carriage moving direction within a box-shaped guide rail. The rack and pinion engaged with each other are attached to the guide rail at the edge of the carriage having the above motor so that the rack and pinion are moved in the horizontal direction with the guide rail being interposed therebetween.

In the above-mentioned structure, when the motor is energized, the motor integrated with the carriage rotates the pinion to move the carriage along the rack. The above-mentioned rotor shaft also acts as the ribbon feed power source.

It is a primary object of the present invention having the above-mentioned structure to omit an intermediate power transmitting member, which is necessary in the conventional technique, such as a wire rope, a toothed belt or a screw shaft, by loading a driving power source directly on a carriage loaded with a printing head, whereby the power loss of the motor as the driving power source, is eliminated.

A second object of the present invention is to eliminate the deviation of the precision of the movement or positioning of the carriage, which is due to stretching or deformation of the intermediate power transmitting member, by omitting the intermediate power transmitting member.

A third object of the present invention is to reduce the space for packaging parts by omitting the intermediate power transmitting member, whereby the size of the printer is diminished and the weight of the printer is reduced.

A fourth object of the present invention is to simplify the structure by omitting the intermediate power transmitting member, whereby the assembling is facilitated and the manufacturing cost is reduced.

DETAILED DESCRIPTION OF THE PREFERRED EMBODIMENTS

The present invention will now be described in detail with reference to embodiments illustrated in the accompanying drawings.

Figure 1:
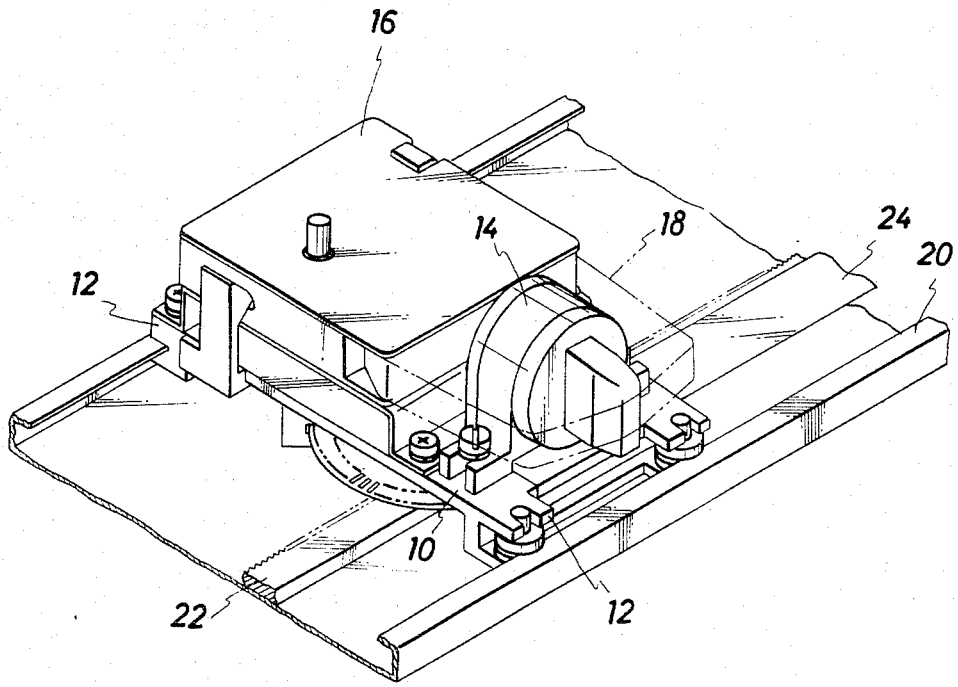
FIG. 1 is a perspective view of a carriage portion, which illustrates one embodiment of the present invention.

Referring to FIG. 1, which is a perspective view of a carriage portion illustrating one embodiment of the present invention, reference numeral 10 represents a carriage, reference numeral 12 represents an edge of the carriage 10, reference numeral 14 represents a printing head loaded on the carriage 10, reference numeral 16 represents a ribbon cartridge loaded on the carriage 10, reference numeral 18 represents an ink ribbon which is contained in the ribbon cartridge 16 and is passed through the printing zone of the printing head 14, reference numeral 20 represents a box-shaped guide rail fitted with the edge 12 of the carriage 10 to support the horizontal movement of the carriage 10, reference numeral 22 represents a rack arranged in the moving direction of the carriage 10 within the guide rail 20, and reference numeral 24 represents a flexible cord extended from a flexible substrate secured to the bottom face of the carriage 10, which will be described hereinafter.

The carriage portion has an appearance as shown in FIG. 1, and a pinion of a flat DC brushless motor, described hereinafter, which is arranged in the bottom portion of the carriage 10, is engaged with the rack 22. Accordingly, by the rotation of this motor, also the pinion is rotated and the carriage 10 is moved along the rack 22, and hence, the printing head 14 and ink ribbon cartridge 16 loaded on the carriage 10 are delivered by the carriage 10.

The flat DC brushless motor contained within the carriage 10, which acts as a driving power source for the horizontal movement of the carriage 10, will now be described.

Figure 2:
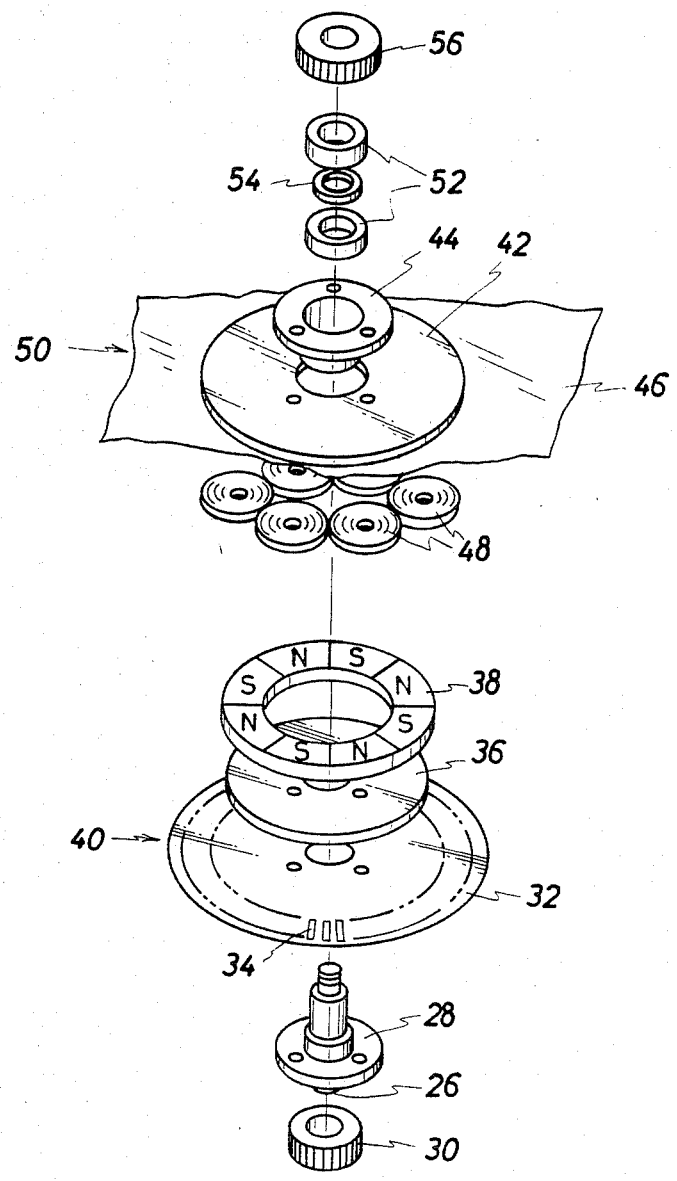
FIG. 2 is a perspective view showing a flat DC brushless motor in the disassembled state.

FIG. 2 is a perspective view showing the flat DC brushless motor in the disassembled state. In FIG. 2, reference numeral 26 represents a rotor shaft of the motor, reference numeral 28 represents a flange of the rotor shaft 26, and reference numeral 30 represents a pinion to be engaged with the rack 22 and the carriage 10 is moved along the rack 22 engaging with the rack 22 by the rotation of the pinion 30. Reference numeral 32 represents a timing slit disc, and many slits 34 for measuring the timing for detecting the rotation position of the rotor, which have the same size, are arranged at equal intervals on the peripheral edge portion of the timing slit disc 32. Reference numeral 36 represents a rotor yoke, and reference numeral represents 38 represents a rotor magnet having many poles S and N arranged alternately in the annular form and the rotor magnet 38 is secured to the rotor yoke 36, while the rotor yoke 36 is secured to the flange 28 of the rotor shaft 26 together with the timing slit disc 32. These members constitute the rotor portion 40. Reference numeral 42 represents a stator yoke having a hole at the center, and reference numeral 44 represents a stator for positioning the rotor portion 40 and the stator 44 is fitted and screwed to the stator yoke 42.

Reference numeral 46 represents a flexible substrate having a predetermined circuit formed thereon, and the flexible substrate 46 is bonded to the bottom face of the stator yoke 42 and the bottom face of the carriage 10 though this feature is not shown in FIG. 2. One end of the flexible substrate 46 extends along the surface of carriage 10 and around edge 12 so that said one end abuts against the circuit terminal of the printing head 14. A part of the flexible substrate 46 is extended to form the above-mentioned flexible cord 24.

A plurality of stator coils 48 (6 coils in this embodiment) are arranged in the annular form below the stator yoke 42 in the state where the coils 48 are electrically connected to the flexible substrate 46. The stator portion 50 is constructed by these members.

The stator portion 50 is integrated with the above-mentioned rotor portion 40 by inserting the rotor shaft 26 into the stator portion 50 to construct a flat brushless motor. Incidentally, an air gap is formed between the stator coils 48 and the rotor magnet 38. In the present embodiment, this air gap is adjusted to about 0.5 mm.

When the rotor portion 40 is integrated with the stator portion 50 in the above-mentioned manner, parts are attached to the top end portion of the rotor shaft 26 projecting from the stator portion 50 in the following manner.

Reference numeral 52 represents a bearing for the rotor shaft 26, reference numeral 54 represents an inner face pressing collar arranged between the bearings 52, and reference numeral 56 represents an output gear attached to the top end of the rotor shaft 26 to feed out the ink ribbon 18. This output gear 56 is engaged with and connected to a ribbon feed power transmitting system described hereinafter.

The assembling operation will now be described with reference to FIG. 3 though explanation of the members described hereinbefore is omitted.

Figure 3:
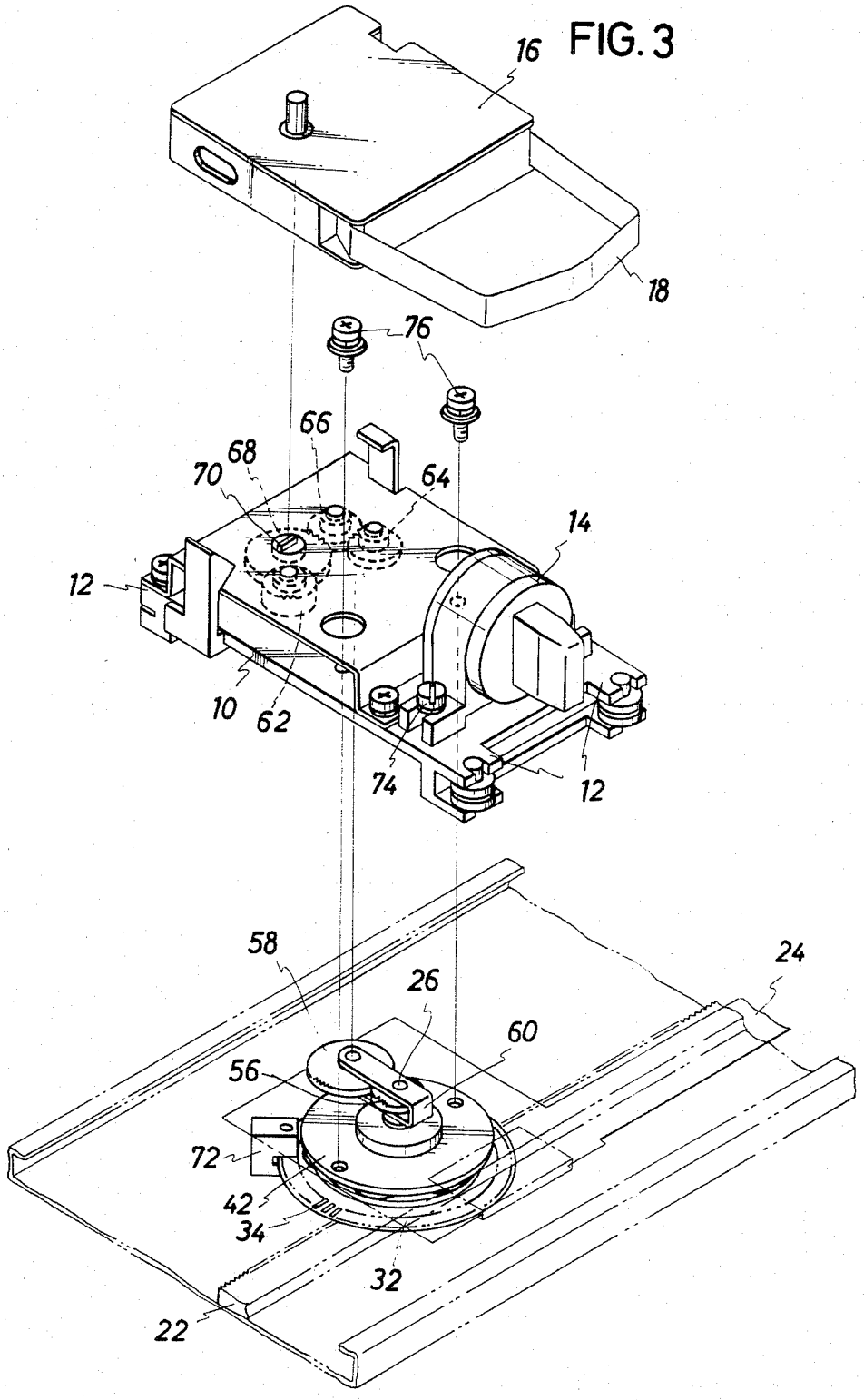
FIG. 3 is a perspective view showing the carriage portion in the disassembled state.

FIG. 3 is a perspective view showing the carriage portion in the disassembled state. In FIG. 3, reference numeral 58 represents a planet gear to be engaged with the output gear 56 secured to the top end of the rotor shaft 26, and reference numeral 60 represents an arm swinging in the rotation direction of the output gear 56 and the arm 60 supports the planet gear 58.

Reference numeral 62 represents an idle gear engaged with the planet gear 58, reference numeral 64 represents an idle gear engaged with the planet gear 58, and reference numeral 66 represents an idle gear engaged with the idle gear 64.

Reference numeral 68 represents a ribbon feed gear engaged with the idle gears 62 and 66 and reference numeral 70 represents an output shaft which is secured to the ribbon feed gear 68 to feed out the ink ribbon 18. These members arranged on the plane constitute a ribbon feed power transmitting system described hereinafter.

Reference numeral 72 represents a detector having light emitting and receiving elements, which is attached to the bottom of flexible substrate 46 through the slit 34 of the timing slit disc 32.

In the present embodiment, the stator yoke 42 of the flat DC brushless motor is contained in the bottom portion of the carriage 10, and the flexible substrate 46 is bonded and secured to the bottom face of the carriage 10 where the stator yoke 42 is located. One end of the flexible substrate 46 extends along the carriage 10 and around edge 12 to abut against the circuit terminal.

The thickness of the flat DC brushless motor is adjusted to about 30 mm and the entire size of this motor is such that the motor can be contained in the bottom portion of the carriage 10, and the pinion 30 of the rotor shaft 26 is engaged with the rack 22 and the output gear 56 secured to the upper portion of the motor is engaged with and connected to the ribbon feed power transmitting system.

Reference numeral 74 represents a clamp screw for securing the printing head on both the sides thereof to the carriage 10, and reference numeral 76 represents a clamp screw for fixing the stator 42 to the carriage 10.

The ribbon feed power transmitting system mentioned above will now be described in detail.

Figure 4:
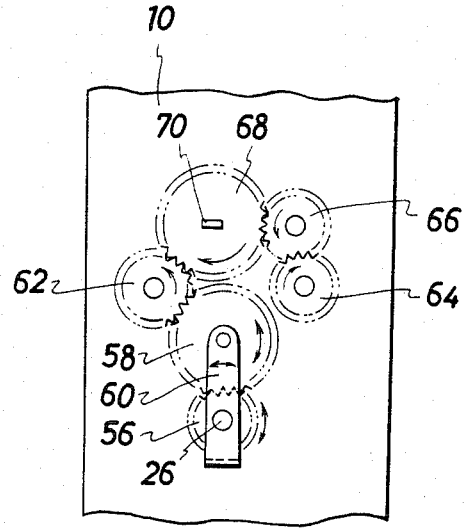
FIG. 4 is a plane view showing a ribbon feed transmitting system.

FIG. 4 is a plane view showing the ribbon feed power transmitting system. In FIG. 4, reference numeral 10 represents a carriage, reference numeral 26 represents a rotor shaft 26, reference numeral 56 represents an output gear, reference numeral 58 represents a planet gear always engaged with the output gear 56, reference numeral 60 represents an arm secured the rotor shaft 26 to move the planet gear 58 in the rotation direction of the rotor shaft 26, reference numerals 62 and 64 represent idle gears engaged with the planet gear 58, reference numeral 66 represents an idle gear always engaged with the idle gear 64, reference numeral 68 represents a ribbon feed gear always engaged with the idle gears 62 and 66 and reference numeral 70 represents an output shaft for securing and supporting the ribbon feed gear 68 thereon and winding the ink ribbon 18 on receipt of the rotation of the ribbon feed gear 68. In the present embodiment, the output shaft 70 is extended into the ribbon cartridge 16 and one end of the ink ribbon 18 is secured to the output shaft 70, though this feature is not shown in the drawings.

The operation of the ribbon feed transmitting system having one face formed on the top face of the carriage as described above is as follows.

The rotor shaft 26 is rotated in the counterclockwise direction, and the planet gear 58 which is rotated in the clockwise direction on receipt of the rotation of the rotor shaft 26 is turned by the arm 60 and engaged with the idle gear 62 to rotate the idle gear 62 in the counterclockwise direction.

The idle gear rotated in the counter-clockwise direction is always engaged with the ribbon feed gear 68 to rotate gear 68 in the clockwise direction. Also the output shaft 70 is rotated in the clockwise direction.

The rotation direction of the rotor shaft 26 is then changed to the clockwise direction. At this moment, the arm 60 is turned in the clockwise direction and the planet gear 58 is rotated in the counterclockwise direction and is engaged with the idle gear 64 to rotate the idle gear in the clockwise direction, and the idle gear 66 always engaged with the idle gear 64 is rotated in the counterclockwise direction. Accordingly, the ribbon feed gear 68 is rotated in the clockwise direction.

The ribbon feed gear 68 should always be rotated in the circumferential direction as described above. Namely, the ribbon feed gear 68 is arranged so that the ink ribbon 18 is always wound and fed in the same direction and even if the rotation direction of the rotor shaft 26 is changed by the change of the moving direction of the carriage 10, the feed direction of the ink ribbon 18 is not changed.

Figure 5:
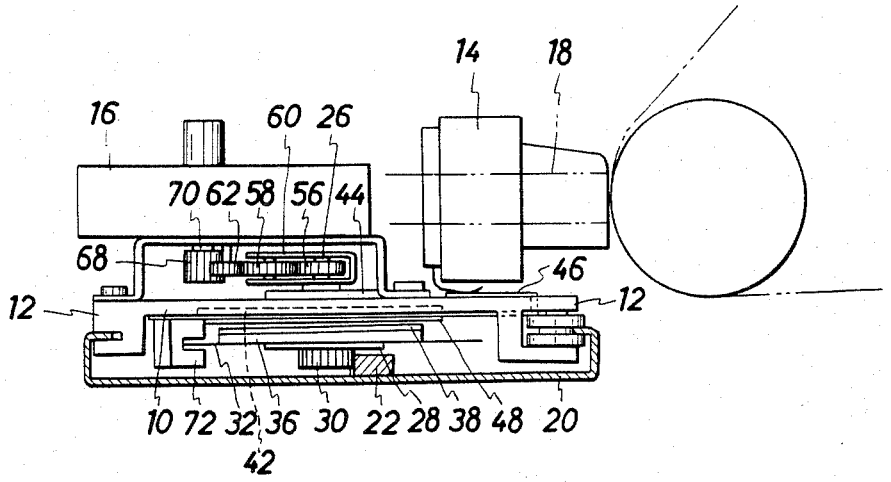
FIG. 5 is a side view of the carriage portion.

The operation of the apparatus will now be described in detail with reference to FIG. 5.

A predetermined voltage is applied to the stator coil 48 from the flexible substrate 46 by using the flexible cord 24 to actuate the rotor magnet 38. At this moment, the rotation angle is detected by the detector 72 bridging the slits 34 of the timing slit disc 32 to rotate the rotor portion 26. The rotor shaft 26 receiving this rotation rotates the pinion 30 located in the bottom portion thereof. The rotated pinion 30 should be moved along the rack 22 with which the pinion 30 is engaged, and hence, the carriage 10 and the members loaded thereon are moved together with the rotor shaft 26.

Simultaneously, also the output gear 56 receiving the rotation of the rotated rotor shaft 26 is rotated and this rotation turns the output shaft 70 for feeding the ink ribbon 18 always in the clockwise direction. Accordingly, the ink ribbon 18 is always fed in the same direction before the printing head 14.

Instructions to the printing head 14 for performing the printing operation are transmitted to the printing head from the circuit terminal kept in contact with the flexible substrate, whereby printing on a printing sheet is effected.

As is apparent from the foregoing detailed description, according to the present invention, a motor is integrally contained in the carriage loaded with the printing head and is used as the driving power source for the carriage. Accordingly, the power loss of the motor due to the presence of an intermediate power transmitting member used in the conventional apparatus, such as a wire rope, a toothed belt or a screw shaft is eliminated, and occurrence of troubles due to stretching or deformation of the intermediate power transmitting member can be prevented. Accordingly, the capacity for accurate delivering and positioning the printing head can be increased.

Since a flat DC brushless motor is used as the driving power source and this motor is contained in the bottom portion of the carriage, the thickness of the apparatus can be reduced. Furthermore, since the entire electric circuit is loaded on the flexible substrate, the number of parts and members can be reduced and the effect of diminishing the size and reducing the weight can be enhanced. Moreover, the assembling steps and procedures are simplified and costs of parts and members are reduced. Accordingly, the manufacturing cost can be reduced.

Since a carriage of the self-running type is used, it is possible to adopt an embodiment in which at least two carriages are arranged in one printer and these carriages are independently moved to effect the delivery operation. Accordingly, the printing speed can be increased and if ink ribbons different in the color are used, multicolor printing can be performed.

Thus, if the printing system of the present invention having a simple structure is applied to a serial printer, various advantages can be attained. For example, the size and weight can be reduced, the printing speed can be increased, the manufacturing cost can be reduced, and multi-color printing can be performed.

What is claimed is:

1. A serial printer comprising a carriage carrying a printing head and moved in a horizontal direction, a motor mounted in the carriage having a rotor shaft extending in a vertical direction, a pinion directly connected to a first end of the rotor shaft of the motor, a rack engaged with the pinion, said rack being mounted parallel to a guide rail for movably supporting the carriage, ink ribbon feed means carried by the carriage for feeding an ink ribbon between the printing head and a printing sheet, said ink ribbon feed means including means to feed the ribbon in a single direction as the carriage moves in both forward and reverse directions, and gear means connected to a second end of the rotor shaft of the motor and engaging said ink ribbon feed means, whereby the carriage loaded with the printing head is moved along the rack by rotating the pinion engaged with the rack by rotation of the motor and said ink ribbon is fed by rotating the gear means engaged with the ink ribbon feed means by rotation of the same motor.

2. A serial printer as set forth in claim 1, wherein the motor is a flat DC brushless motor.

3. A serial printer as set forth in claim 1, wherein the motor is directly attached to a horizontal flat portion of a carriage frame.

4. A serial printer as set forth in claim 1, wherein a stator yoke of the motor is directly secured to a carriage frame.

5. A serial printer as set forth in claim 1, wherein a position-detecting timing slit disc is attached to the rotor shaft of the motor.

6. A serial printer as set forth in claim 5, wherein an optical detector is attached to the carriage so that the optical detector bridges a slit-formed circumferential portion of the timing slit disc.

7. A serial printer comprising a carriage carrying a printing head and moved in a horizontal direction, a motor integrally carried by the carriage and having a rotor shaft extending in a vertical direction, ink ribbon feed means carried by the carriage to feed an ink ribbon between the printing head and a printing sheet, said ink ribbon feed means including means to feed the ribbon in a single direction as the carriage moves in both forward and reverse directions, ink ribbon feed driving means for driving said ink ribbon feed means, means for guiding the carriage means of or the horizontal movement said guiding means being arranged parallel to the direction of movement of the carriage means, said guiding means having a rack formed on one face thereof, first rotation gear means for moving the carriage attached to a first end of the rotor shaft and engaging the rack, and second rotation gear means attached to a second end of the rotor shaft and engaging said ink ribbon feed driving means, wherein the movement of the carriage and the feeding of the ink ribbon are both performed through the motor loaded on the carriage.

8. A serial printer as set forth in claim 7, wherein said ink ribbon feed driving means includes means for rotating said ink ribbon feed means in a single direction of rotation regardless of the direction of rotation of said rotor shaft.

9. A serial printer as set forth in claim 8, wherein said ink ribbon feed driving means is a planet gear mechanism.

* * * * *